US006536420B1

(12) United States Patent
Cheng

(10) Patent No.: US 6,536,420 B1
(45) Date of Patent: Mar. 25, 2003

(54) GAS SWIRLING DEVICE FOR INTERNAL COMBUSTION ENGINE

(76) Inventor: Theodore Y. Cheng, 111 W. Fairview Ave., San Gabriel, CA (US) 91776

( * ) Notice: Subject to any disclaimer, the term of this patent is extended or adjusted under 35 U.S.C. 154(b) by 0 days.

(21) Appl. No.: 09/583,090

(22) Filed: Apr. 13, 1999

Related U.S. Application Data

(63) Continuation-in-part of application No. 08/618,284, filed on Mar. 18, 1996, now abandoned.

(51) Int. Cl.[7] ..... F02M 29/06

(52) U.S. Cl. ..... 123/590; 123/592; 48/189.4

(58) Field of Search ..... 123/590–593; 48/189.4, 189.5

(56) References Cited

U.S. PATENT DOCUMENTS 4,962,642 A * 10/1990 Kim ..... 123/590

* cited by examiner

*Primary Examiner*—Erick Solis
(74) *Attorney, Agent, or Firm*—Gene Scott-Patent Law & Venture Group

(57) ABSTRACT

Swirl is imparted to an air intake charge by a gas swirling device which may be inserted into an air intake hose or secured to a throttle body. The gas swirling device has a cylindrical body which is split along a generally longitudinally extending seam to allow the device to adjust its radial dimension. The device is formed from a single piece of bendable material and includes a plurality of swirling vanes which are formed integral with the cylindrical body of material and which are bent radially inwardly toward the central axis of the cylinder. In an embodiment for axial air flow, each of the blades is skewed relative to the axis of the cylinder for changing the direction of air flow through the cylinder and to encourage swirl in the air flow.

24 Claims, 10 Drawing Sheets

Fig. 3C
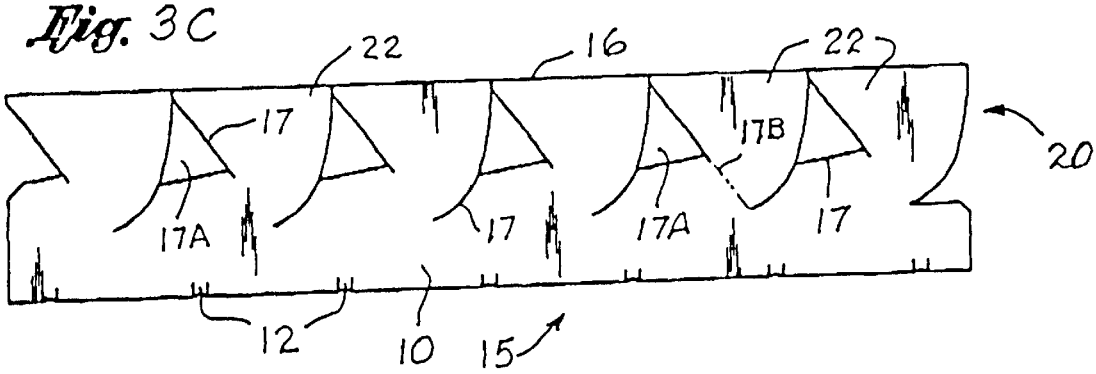
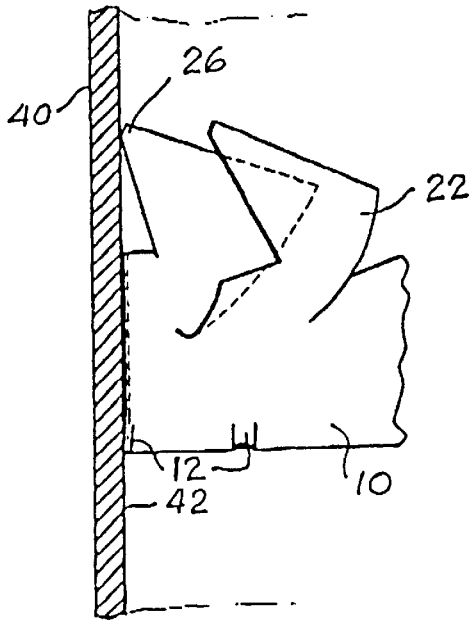
Fig. 3B
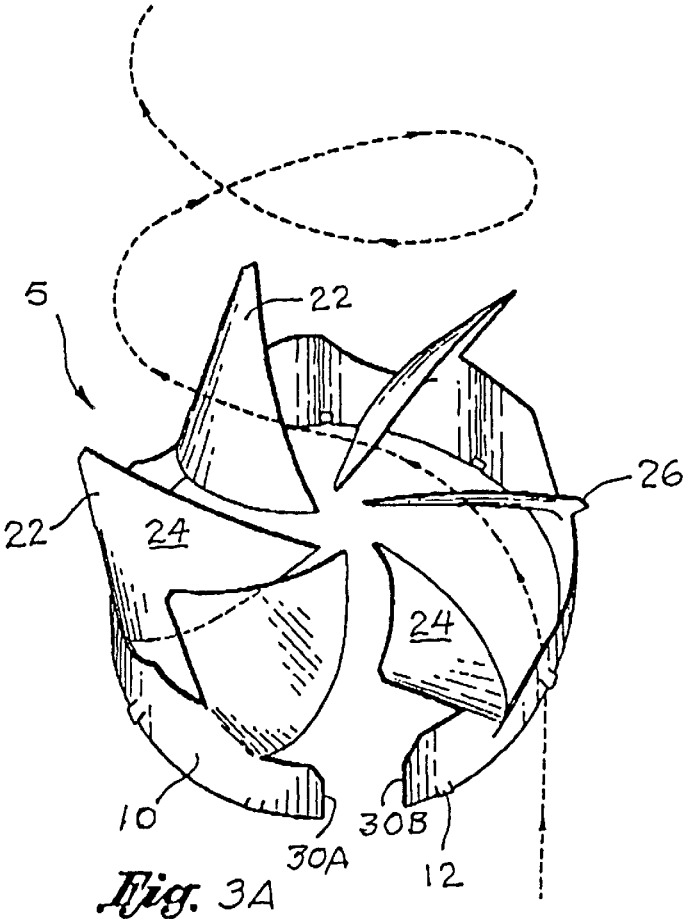
Fig. 3A

Fig. 4C
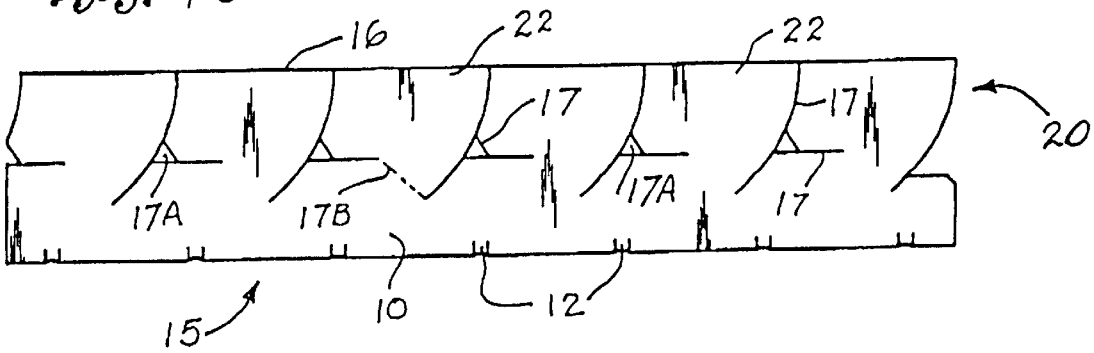
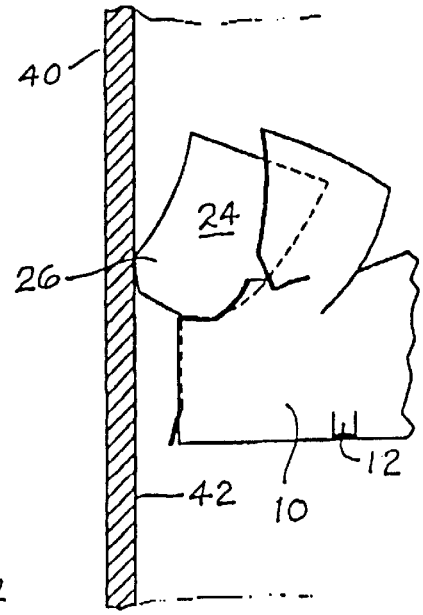
Fig. 4B
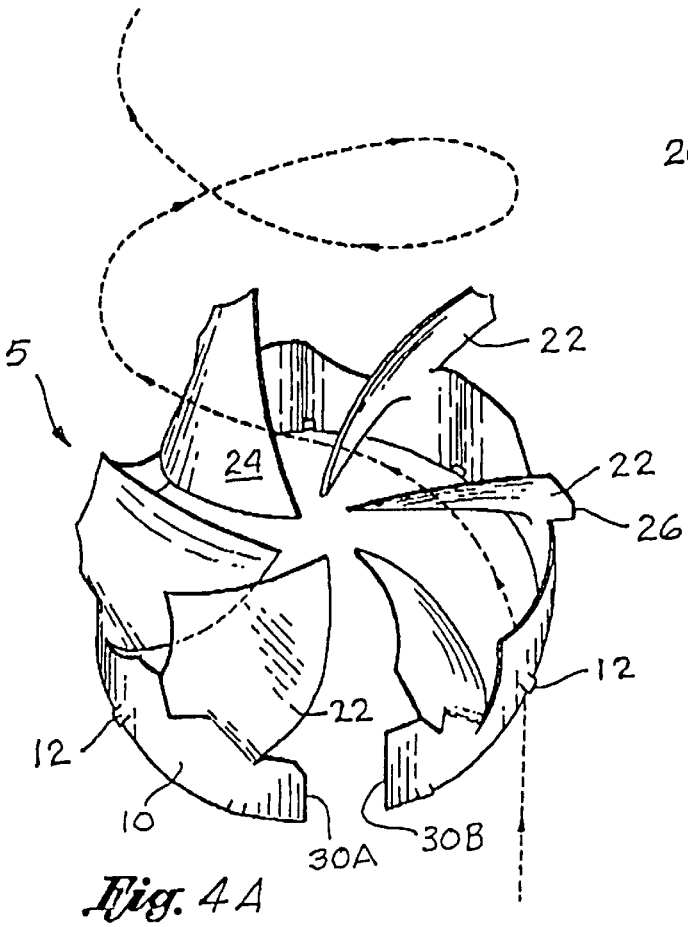
Fig. 4A

GAS SWIRLING DEVICE FOR INTERNAL COMBUSTION ENGINE

This application is a continuation-in-part of prior filed application Ser. No. 08/618,284, filed on: Mar. 18, 1996 now abandoned.

FIELD OF THE INVENTION

The present invention is directed to a gas swirling device for improved mixing of air and fuel in an internal combustion engine and more particularly to an economical gas swirling device disposed in an air conduit between an air filter and an engine air-intake manifold and having a plurality of vanes to cause swirling of a gas downstream from the device.

BACKGROUND

In internal combustion engines, including spark ignition-type automobile engines, it is well known that more complete mixing of air and fuel in the combustion chamber improves the ignition spark propagation, giving more complete combustion which, in turn, results in added power, lower emissions, and a more economical use of fuel. Improved fuel-air mixing by increasing swirl flow has been heretofore accomplished by the addition of expensive add-on hardware, such as mechanized turbo chargers or blowers, to an automobile engine. While installation of this kind will increase the power output of an engine, they are generally quite expensive and require the services of a skilled technician both for installation and on-going maintenance.

It is known that generating a swirling motion to an induction charge about the axis of an engine cylinder can have multiple benefits. A swirling motion imparted to the charge produces better charge preparation, and improves the combination of this charge within the combustion chamber. In a spark-ignition homogeneous engine operation, an increase in the cylinder charge rotative speed generally improves the burn rate and results in decreased fuel consumption. In stratified charge engines, swirling can promote mixing of the rich core of fuel in the surrounding air, to reduce exhaust emissions and fuel consumption. In diesel engines, swirling has long been used to promote fuel-air mixing for lower NOx emissions and soot formation.

Swirl rate is normally measured in terms of "swirl numbers", normally defined as the ratio of in-cylinder charge rotative speed to engine rotative speed. Previously, engine "swirl numbers" have been improved by installing an air swirling device upstream of the engine air intake ports. Such devices, however, are typically either expensive add-on mechanical systems such as turbo charges or blowers, or add-on stator devices which are adapted to be used with a specific engine/carburetor or fuel injector combination, or alternatively adapted to be contained within a specially designed air filter. Add-on components such as turbochargers or blowers, while able to increase the power output of an engine, are quite expensive and require the services of a skilled technician both for initial installation and follow-on maintenance.

Several attempts have been made in the prior art to fashion a simple, easy to use, and inexpensive gas swirling device. While able to provide some increase in "swirl number" when adapted to an automotive engine, these prior art devices all suffer from the particular defect of over-complexity. This has significant negative impact on their overall simplicity and manufacturing cost.

U.S. Pat. No. 4,962,642 discloses an air flow system which includes a stator device having a plurality of vanes which are disposed about the central axis of the air filter for causing an inlet air charge to swirl. However, the cross-sectional area of the disclosed stator device is sufficiently large to obstruct the engine air intake inlet, causing a pressure drop on the downstream side of the stator device with a consequent reduction of intake air volume.

U.S. Pat. No. 4,274,386 discloses a stationary fuel vaporization stator comprising a thin plate which is mounted between an autoclaimmotive engine carburetor and the opening of an intake manifold. Through-openings are provided in the plate which have the same outside diameter as the opening between the carburetor and the intake manifold, and a plurality of triangular shaped vanes are disposed about the circumference of the openings to help increase the turbulence of the fuel-air mixture while at the same time funneling any remaining liquid portion of the mixture toward the center of the opening of the plate. However, this device is only useful in carbureted engines, and must be constructed in multiple configurations so as to fit the various carburetor types provided on various make and model year automotive engines.

U.S. Pat. No. 5,113,838 disclosed an air swirl stator device adapted to be mounted along the central axis of an air filter. The stator device is a generally hollow cylinder and includes a plurality of vanes projecting into the cylinder for imparting a swirling motion to intake air. The stator device, however, is disclosed as functioning in combination with an annular shaped air filter and has a characteristic size and shape so as to fit in proper position. Moreover, the discloses stator device is difficult to manufacture; each vane is individually fashioned and separately mounted in a specific angular location along the inside wall of the stator's cylindrical housing. Accordingly, several cutting and mounting operations are required to complete one device.

Commercially available swirling devices are assembled from many components spot welded or otherwise connected together. As such, the manufacturing costs associated with multiple part assemblies are too high.

Accordingly, it would be desirable to have an easy to manufacture gas swirling device that can be retro-fitted to existing automobile engines as well as installed in new ones. Advantageously, such a gas swirling device would have no moving parts, be easy to install and remove, would not require that any modifications be made to the automobile engine or its components, and be economical to manufacture. Such a gas swirling device would improve the "swirl number" of an automotive engine but, at the same time, avoid any consequential reduction in air flow volume which could starve the engine of air and cause incomplete combustion and sluggishness.

SUMMARY OF THE INVENTION

A gas swirling device in accordance with the present invention is provided for use in an internal combustion engine. The device is adapted to be mounted in a flexible hollow air conduit between an air filter and an intake manifold or, alternatively, to be secured directly to, for example, a throttle body.

In one aspect of the present invention, the gas swirling device is formed from a single sheet of a flexible, bendable material into a substantially cylindrical body which is open at both ends. A plurality of stationary vanes are provided integral with and formed from the sidewall of the body, with each vane being disposed at an oblique angle with respect to a plane parallel to and passing through the body's cylindrical axis.

In particular, each vane is constructed by cutting the body sidewall to from an incompletely severed trapezoidal portion which remains affixed to the body along an uncut side. The trapezoidal portion is deformed radially inwardly away from the body about an axis defined by the affixed side. The vane deformation axis defines an angle oblique to the cylindrical axis, such that, when deformed radially inwardly, each vane presents an interior face at an angle to a gas flow through the device, where the gas flow is in a direction parallel to the cylindrical axis.

In another aspect of the present invention, the circumference of the cylindrical body is not continuous but, rather, is split open along an axially extending seam to allow the housing of the air swirling device to circumferentially flex for fitting the cylinder into different sizes of openings. Retaining means are provided to allow the cylinder to be securely affixed to, for example, a throttle body. In particular, the retaining means may include tabs provided integral to and formed from the sidewall material of the throttle body and also include screw holes provided therethrough for screwing or bolting the gas swirling device in proper position over a throttle body.

In accordance with practice of principles of the present invention, the vanes provided integral with and formed from the cylindrical sidewall material of the body may be triangular in shape, trapezoidal, or rhombic. Regardless of shape, each vane is twisted concavely from a plane for smoothly changing the direction of air flowing across the concave surface of the blade.

BRIEF DESCRIPTION OF THE DRAWINGS

These and other features, aspects, and advantages of the present invention will be more fully understood when considered with respect to the following detailed description, appended claims and accompanying drawings, wherein;

FIGS. 3A–C illustrate a further embodiment thereof showing a perspective view, a partial elevational side view and preferred position in an air intake tube (the tube shown in section), and a flat layout view respectively;

FIGS. 4A–C illustrate a still further embodiment thereof showing a perspective view, a partial elevational side view and preferred position in an air intake tube (the tube shown in section), and a flat layout view respectively;

DETAILED DESCRIPTION

The present invention, as described above, provides a flexible sheet material providing a first portion formed as an open round cylinder, and a second portion formed along at least one peripheral edge of the open cylinder as a plurality of individual blades evenly spaced around a circumference of the open cylinder. As previously described, the first and second portions are formed integrally and contiguously from the sheet material, each of the blades providing a smoothly and continuously curved radially directed surface primarily positioned inboard of the circumference, and shaped so that the air moving through the device is caused to move cyclonically, that is, to swirl or rotate as it moves through the open round cylinder. The preferred and improved embodiments of the present invention comprise a means for causing rotational acceleration of the cyclonically moving air and for simultaneously causing advantageous mixing thereof.

Figure 1:
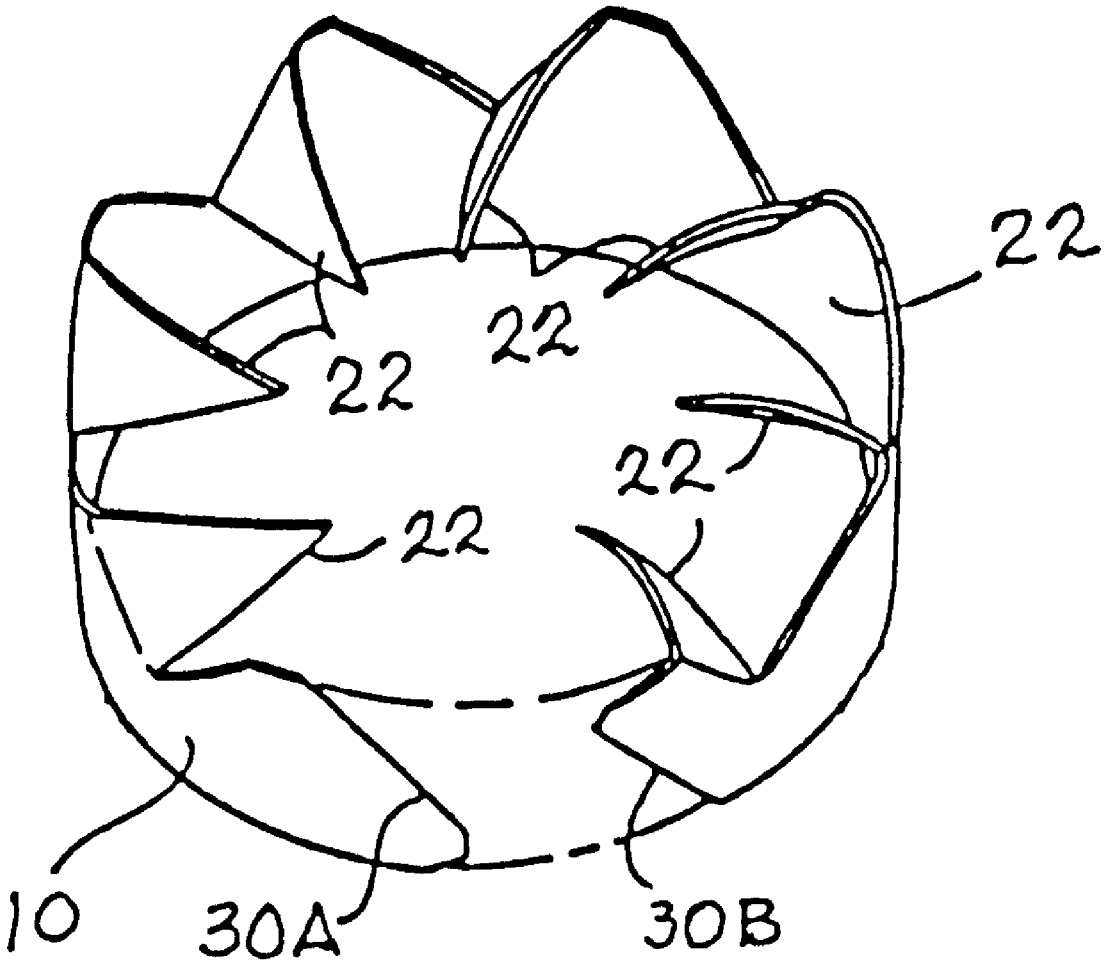
FIG. 1 is a perspective view of a preferred embodiment of the present invention.
Figure 2:
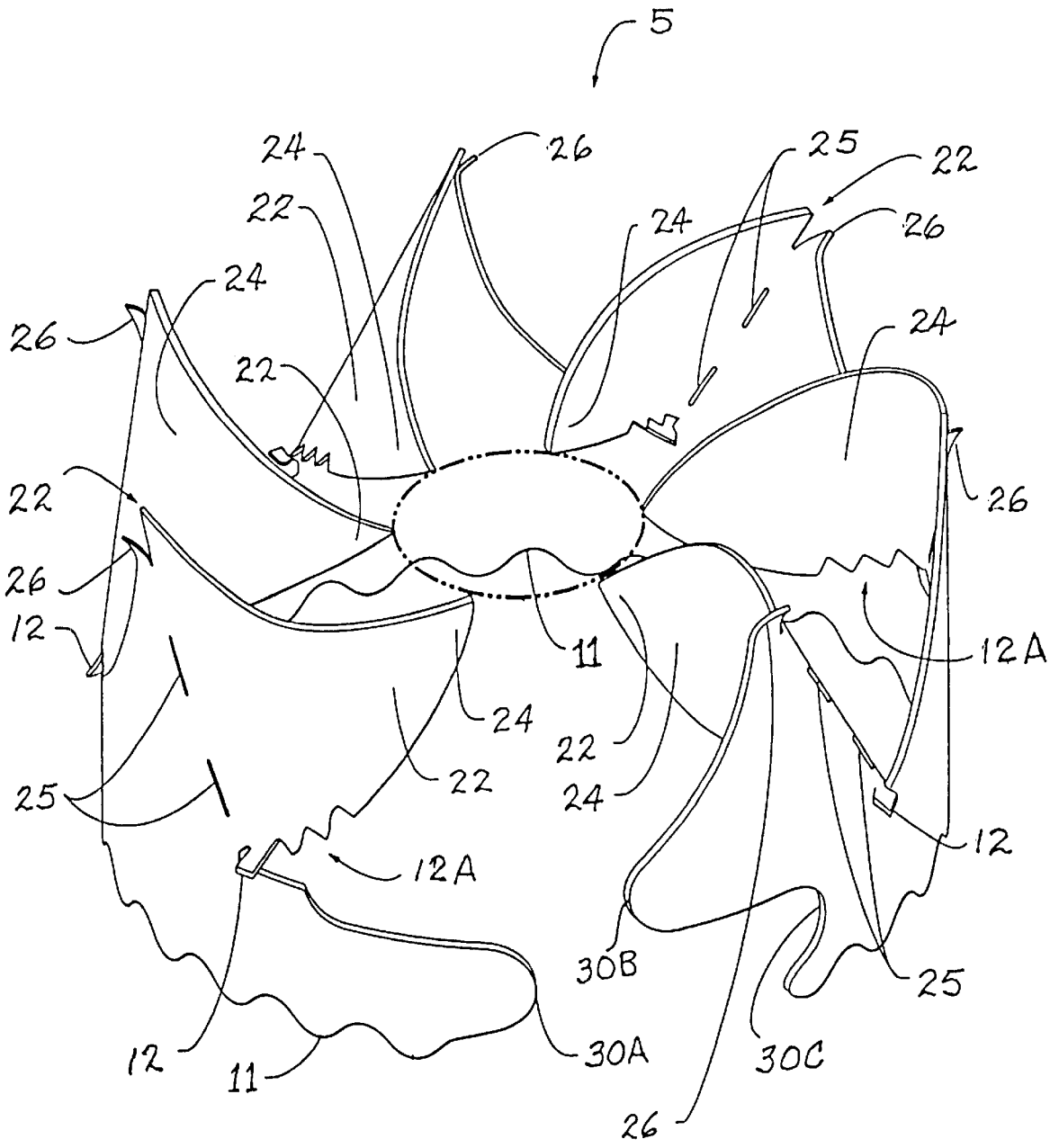
FIG. 2 is a further embodiment thereof.
Figure 5:
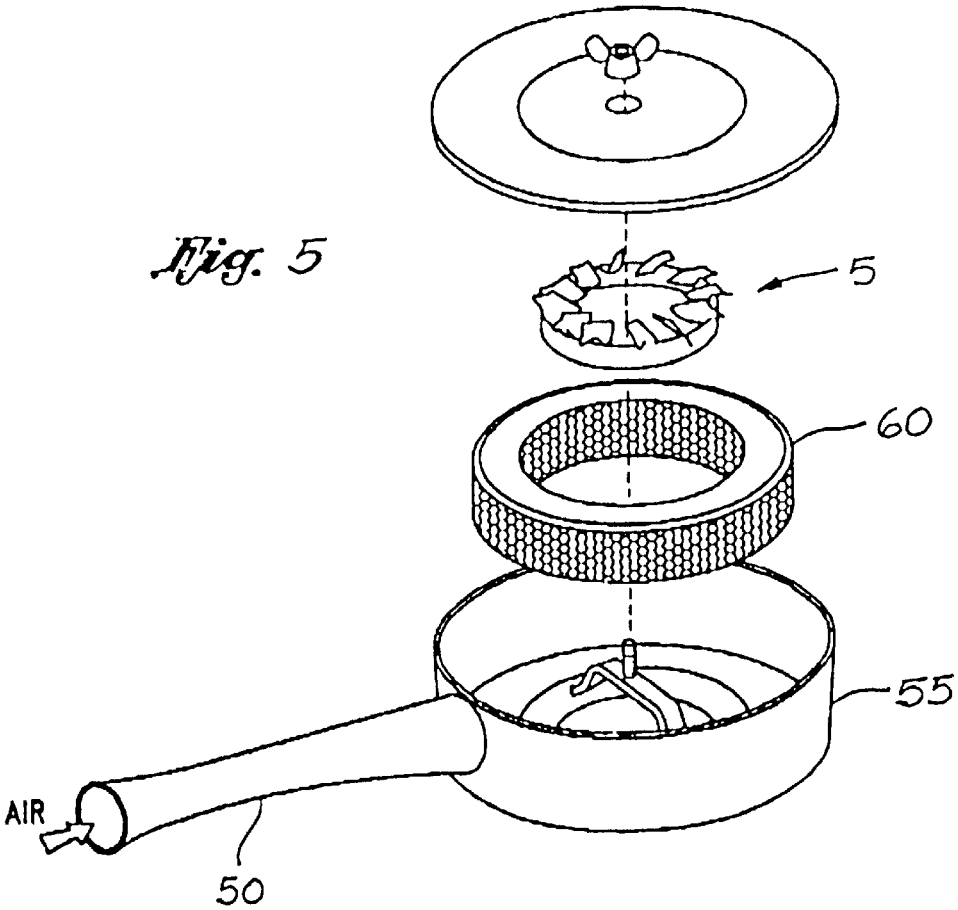
FIG. 5 is a perspective exploded view showing an alternate embodiment and its application.
Figure 6:
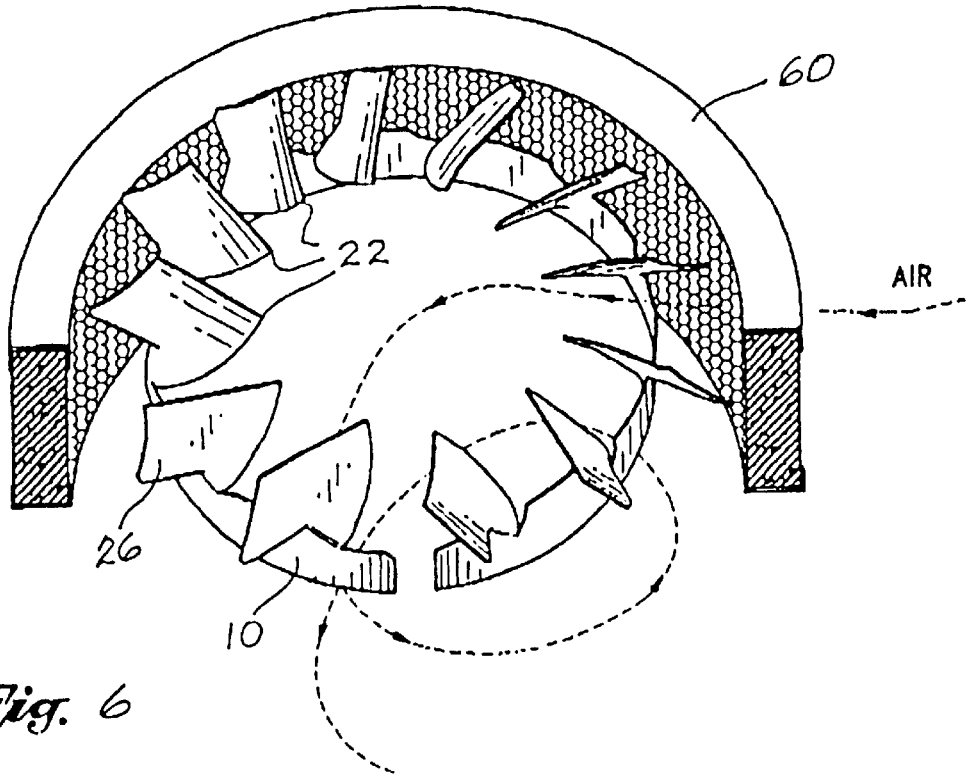
FIG. 6 is a perspective, partial breakaway, closeup view of portions of FIG. 10 depicting the relationship therebetween.
Figure 7:
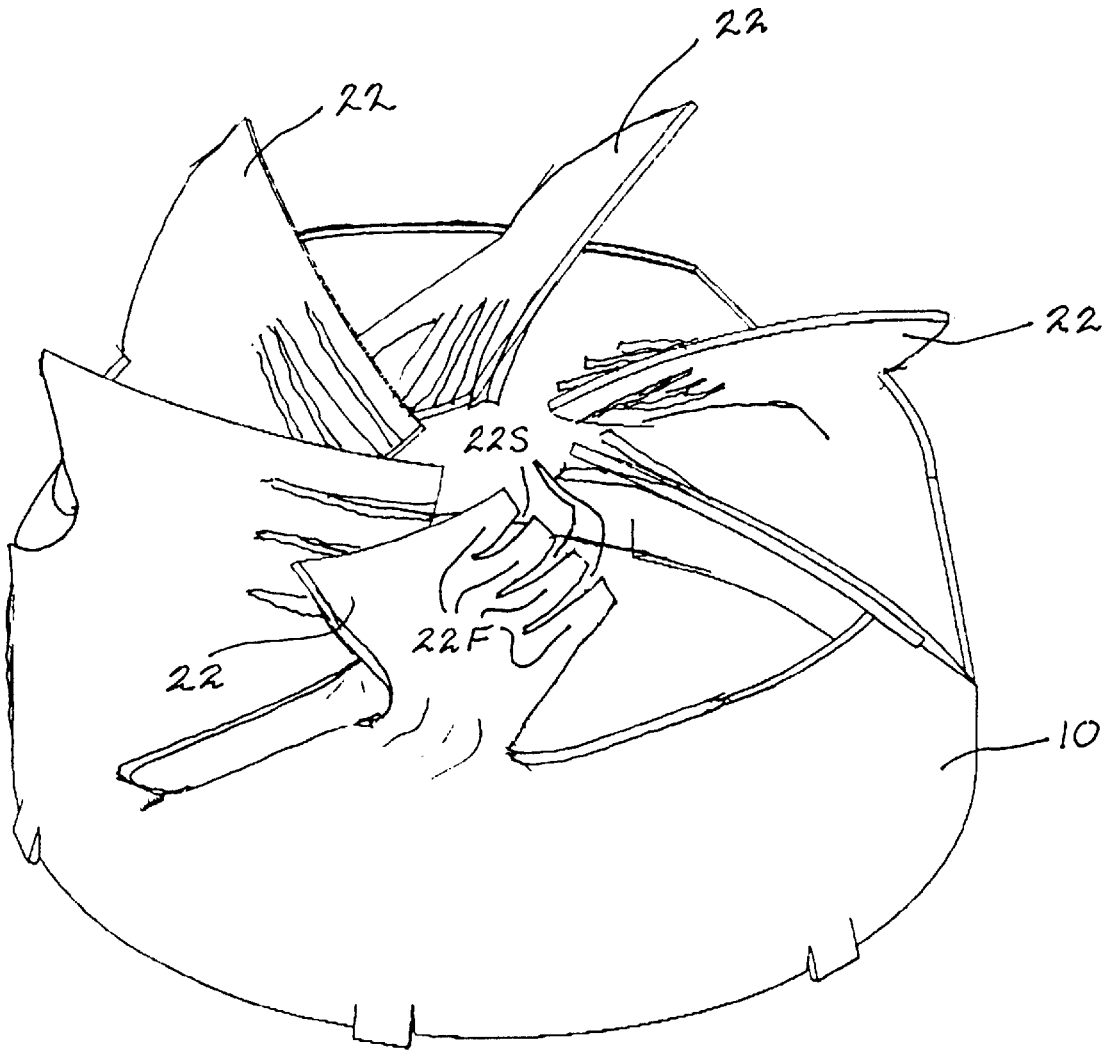
FIG. 7 is a perspective view of an alternate embodiment of the invention showing split blades.

In one embodiment of this improved invention, as shown in FIG. 7, the device as previously described provides the directed surfaces 22 (also referenced above as blades) as partially split by a plurality of generally parallel slits 22S to form a plurality of terminal fingers 22F, the fingers being directed mutually divergently and preferably forming an acute angle of between 3 and 15 degrees with each other of the fingers 22F adjacent thereto, that is, on the same blade. It should be noted that the air moving axially through the directed surfaces 22 is caused to break significantly with laminate flow conditions thereby causing vigorous mixing to occur. 44. Also, the fingers 22F are positioned for directing portions of the air moving through the device in divergent circumferential directions for accelerating the cyclonically moving air.

Figure 8:
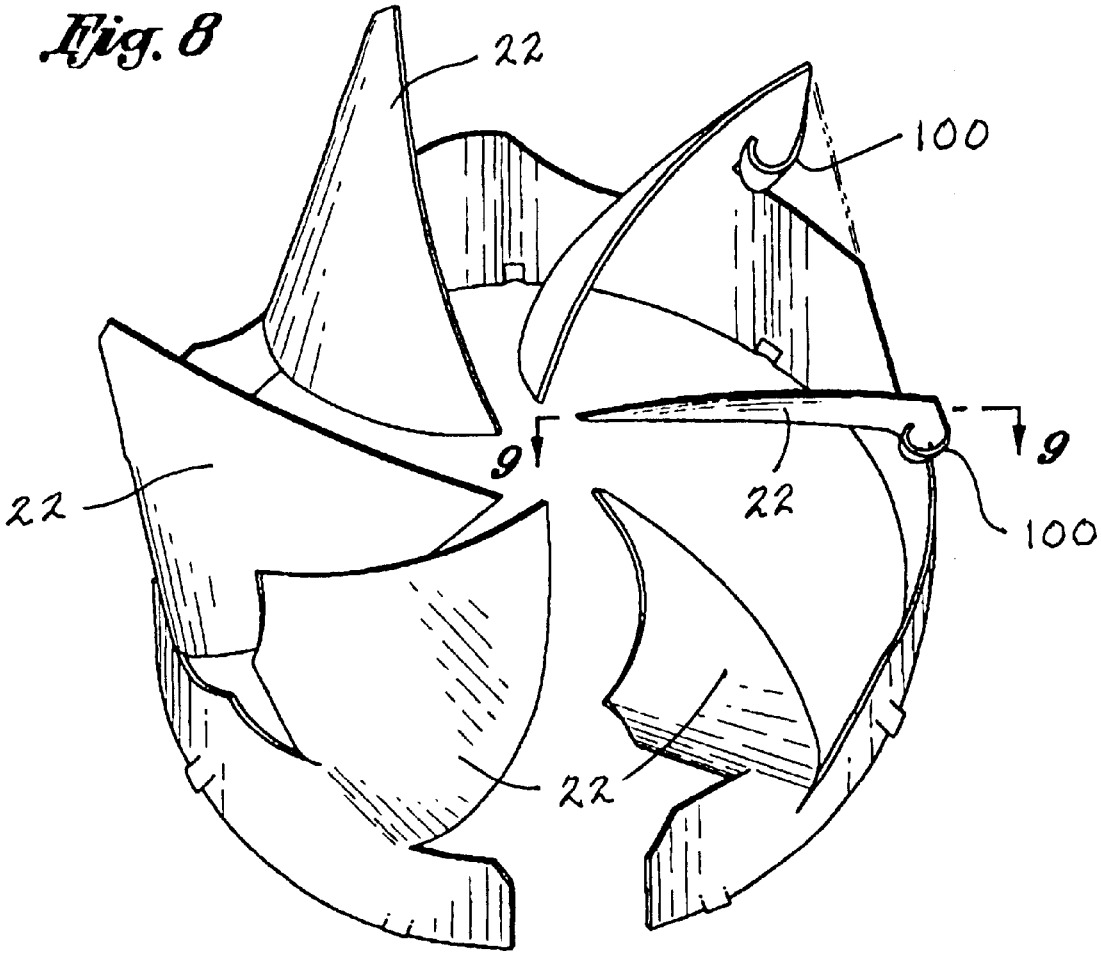
FIG. 8 is a perspective view of a further alternate embodiment of the invention showing curbed blade end portions.
Figure 9:
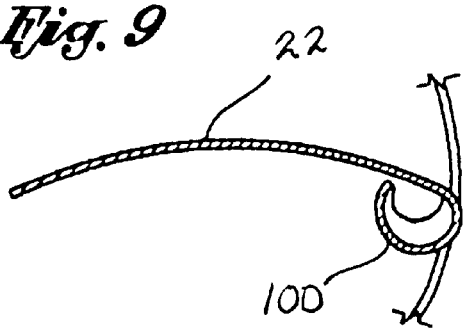
FIGS. 9 and 10 are sectional views taken along line 9—9 of FIG. 8 showing alternates in the manner in which the blade ends may be curved.
Figure 10:
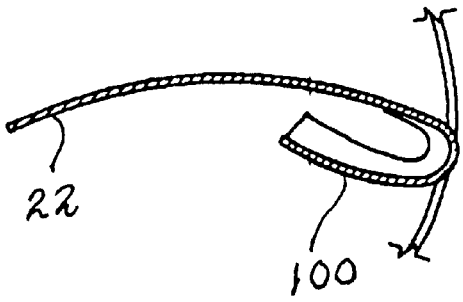

In another embodiment of this improved invention, as shown in FIG. 8, the device as previously described provides the directed surfaces 22 (also referenced above as blades). Inventively, each of the directed surfaces 22 further comprises a folded blade portion 100 formed into a funnel shape, the funnel shape being tapered in the direction of air flow within the funnel shape so as to accelerate the velocity of the air flow therewithin. The funnel shapes are inventively skewed to one side in order to vector the accelerated air circumferentially for improved mixing and for accelerating the cyclonically moving air. In FIGS. 9 and 10 are shown variations on the funnel shape that have been found to be advantageous. Other variations may be used advantageously within the scope of this description and related figures.

Figure 11:
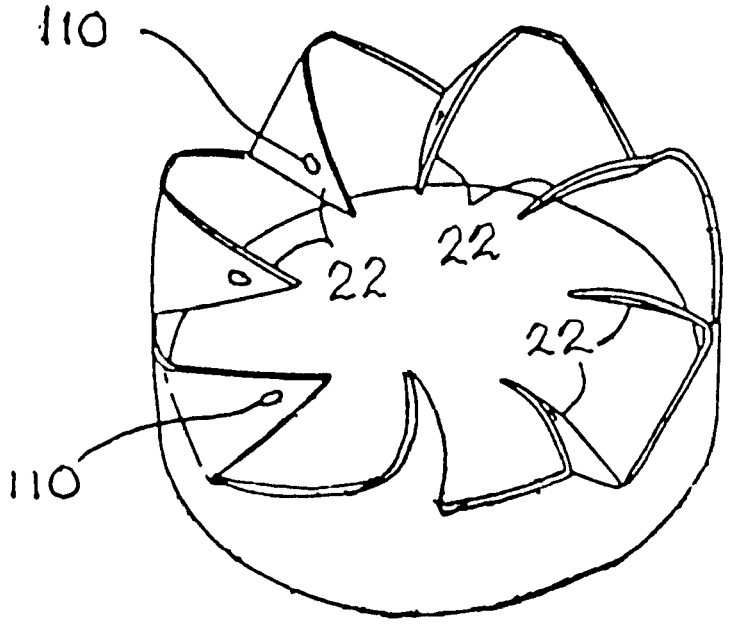
FIG. 11 is a perspective view of a still further alternate embodiment of the invention showing the placement of holes in the blades of the invention.
Figure 12:
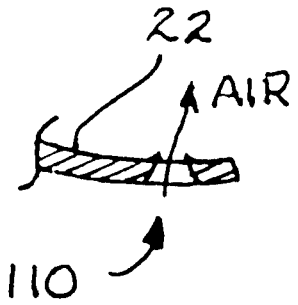
FIG. 12 is a sectional view through one of the blades of FIG. 11 showing a preferred formation of the holes therein.

Alternatively, and inventively, as shown in FIGS. 11 and 12, each of the directed surfaces 22 may further comprise at least one hole 110 as shown in FIG. 11 therethrough, the hole 110 being tapered, as shown in FIG. 12 in the direction of air flow through the hole 110 so as to accelerate the velocity therefrom, the hole being directed circumferentially for vectoring the accelerated air circumferentially for improved mixing and for accelerating the cyclonically moving air. The extent of the hole 110 may be lengthened by swaging the hole 110 so that it protrudes from the directed surface 22 as is shown in FIG. 12.

Figure 13:
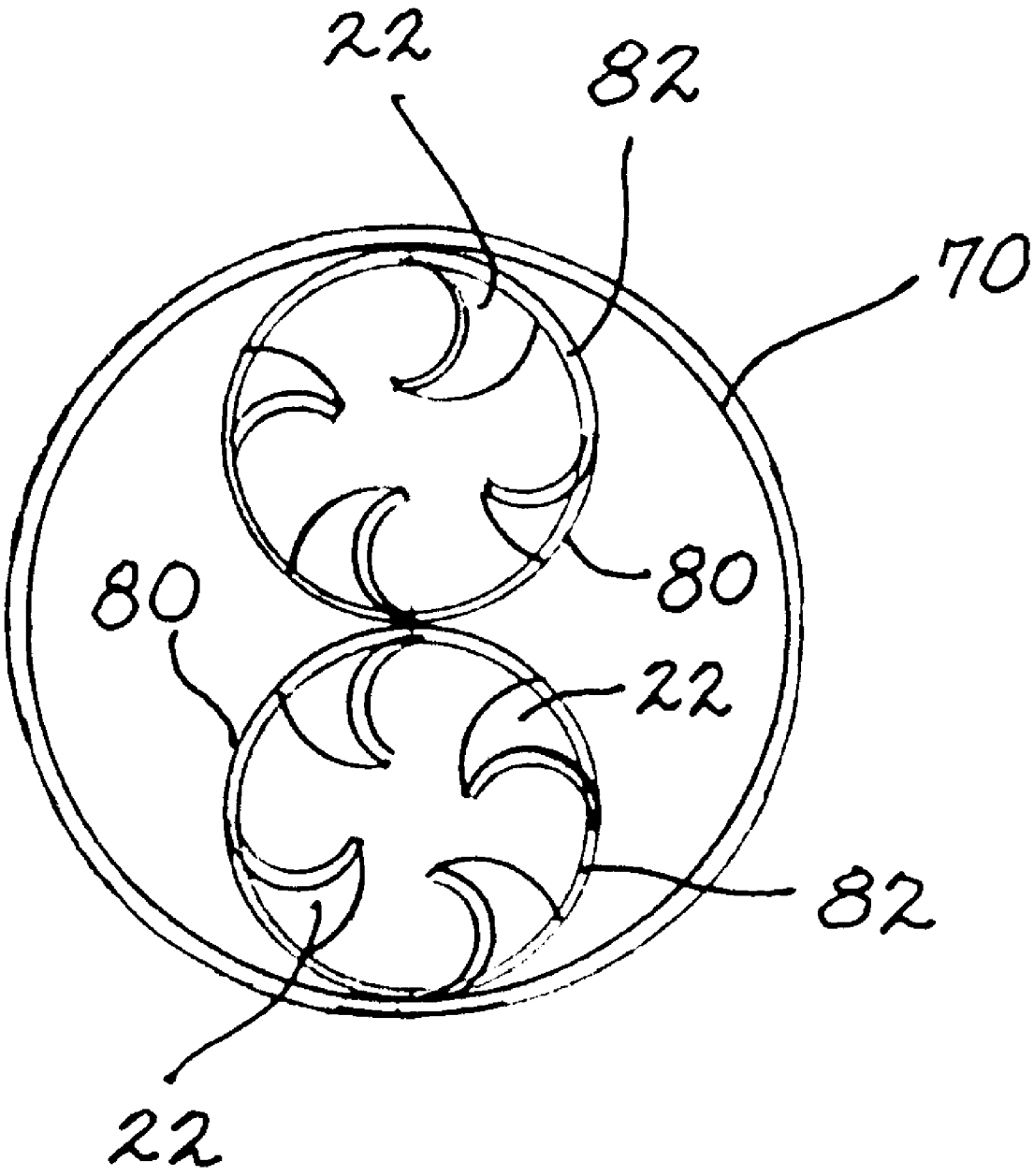
FIG. 13 is a plan view of an alternate embodiment of the invention showing multiple minor blade hoops held within a major hoop.

In a still further embodiment of the invention, shown in FIG. 13, the flexible sheet material provides an open exterior cylinder 70 as described above, and integral, as by welding for example, therewith, a plurality of open interior cylinders 80 as shown in FIG. 8, each of the interior cylinders 80 having a peripheral edge 82 forming, in spaced apart fashion, a plurality of individual blades 22 evenly spaced around a circumference thereof, the blades 22 formed integrally and contiguously from the sheet material providing a smoothly and continuously curved radially inwardly directed surface and shaped so that air moving axially through the interior cylinders 80 is caused to rotate as it moves therethrough. The blades of the interior cylinders 80 may be curved to cause the air moving therethrough to rotate in the same direction through each of the interior cylinders or in opposing directions, i.e., clockwise through one of the cylinders 80 and counter-clockwise through an adjacent one of the cylinders 80. The later arrangement results in improved gas mixing, while the former results in improved acceleration of the total volume of gas throughput.

Figure 14:
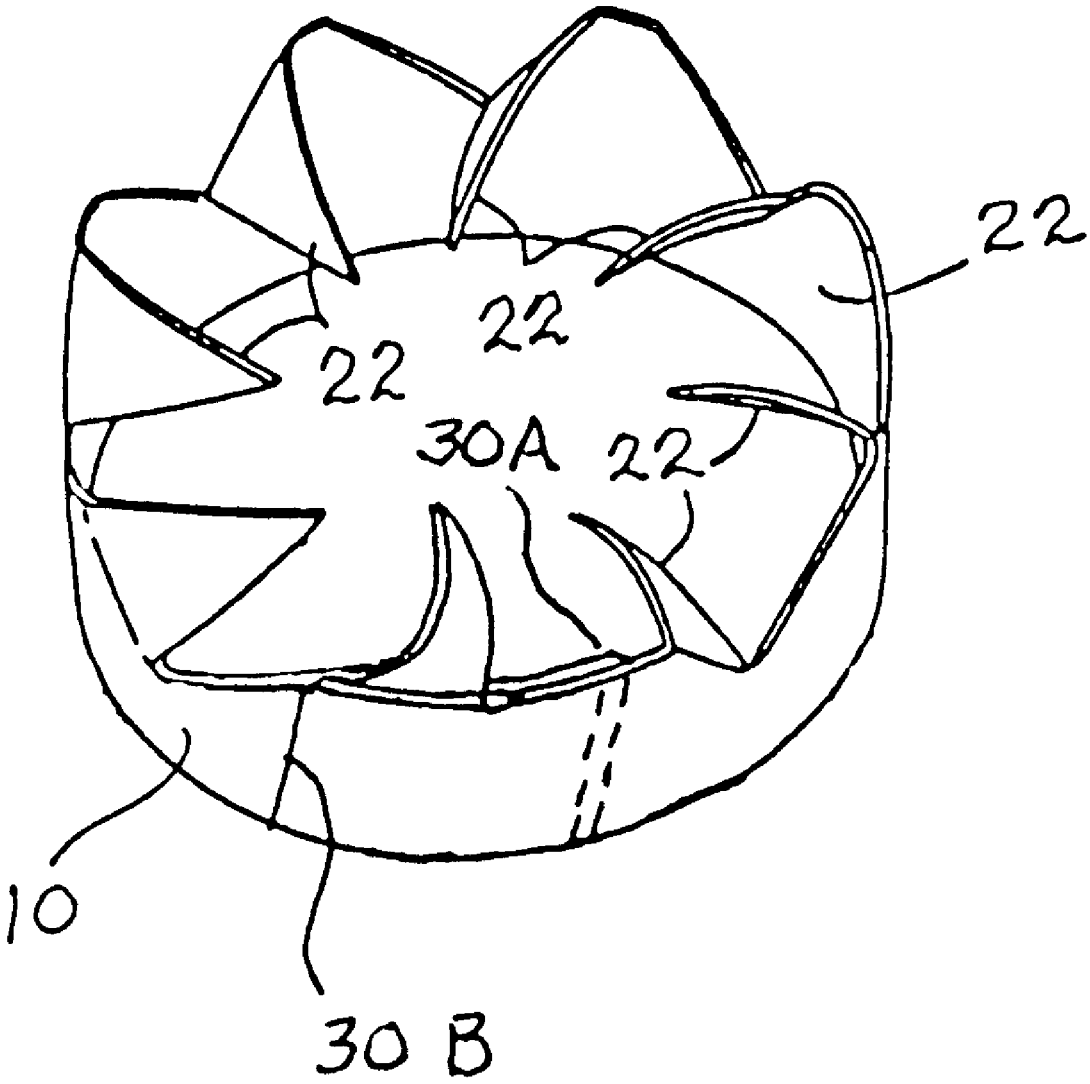
FIG. 14 is a perspective view of the invention showing a hoop with overlapping ends.

In each of the embodiments described above the opposing edges 30A and 30B of the open cylinder may be formed to mutually overlap, as shown in FIG. 14, so as to enable increased spring pressure within the cylinder. Clearly, it can be shown that the total spring pressure of a cylindrical hoop is the sum of the pressure exerted by each small circumferential interval around the hoop. Therefore with a given circumference, as in the present case in automotive applications, and with a given material, material thickness and spring temper heat treatment, it is possible to obtain improvements in spring force for improved holding ability of the hoop within a hose, for instance, by extending the length of the hoop to overlap itself as shown in FIG. 14.

Thus, although the present invention has been described with reference to the various embodiments, above, it will be apparent that numerous modifications may be devised by those skilled in the art. Accordingly, it is to be understood that the air swirling device according to the principals of the invention may be embodied other than as specifically described herein. The scope of the invention is defined only by the scope of the appended claims.

What is claimed is:

1. An air swirling device comprising: a flexible sheet material providing a first portion formed as an open round cylinder, and a second portion formed along one peripheral edge of the open cylinder as a plurality of individual blades evenly spaced around a circumference of the open cylinder, the first and second portions being formed integrally and contiguously from the sheet material, each of the blades providing a smoothly and continuously curved radially directed surface primarily positioned inboard of the circumference, and shaped so that air moving axially through the device or radially into the device is caused to rotate; wherein each of the blades provides a plurality of linear slots arranged end-to-end to form a weakened section in the sheet material so as to more easily direct the blade into a radial direction.

2. The device of claim 1 wherein the open cylinder provides opposing edges, the opposing edges, when joined, forming a continuous ring, the sheet material being of such temper as to enable the open cylinder to be sprung for biasing the opposing edges in a spaced apart condition, such that when the spaced apart condition must be reduced for inserting the device into an air conduit, the cylinder exerts an outward hoop stress on an inner wall surface of the air conduit for improved engagement of the device with the air conduit.

3. The device of claim 2 wherein the opposing edges are cut at an angle to a longitudinal axis of the open cylinder for providing a partial interlocking of the opposing edges.

4. The device of claim 2 wherein the opposing edges provide a shape so that one of the edges fits within the other of the edges for providing a partial interlocking of the opposing edges.

5. The device of claim 2 further including a retaining means formed from the open cylinder first portion and extending radially outwardly therefrom for improved engagement of the device with the air conduit.

6. The device of claim 5 wherein the retaining means comprises a plurality of spaced apart tabs.

7. The device of claim 2 wherein each of the blades provides at least one radially outwardly extending portion for engaging the inner wall surface of the air conduit.

8. The device of claim 2 wherein the open round cylinder first portion provides an undulating curvature forming an annular edge thereon, such that with the first portion in contact with the inner wall surface of the air conduit, the annular undulating edge provides improved engagement between the device and the air conduit.

9. A combination intake manifold, air filter, and air swirling device, the combination comprising: a flexible sheet material providing a first portion formed as an open round cylinder, and a second portion formed along one peripheral edge of the open cylinder as a plurality of individual blades evenly spaced around a circumference of the open cylinder, the first and second portions being formed integrally and contiguously from the sheet material, each of the blades providing a smoothly and continuously curved radially directed surface primarily positioned inboard of the circumference; a cylindrically formed air filter positioned concentrically with the open cylinder; an intake manifold positioned within the circumference of the open cylinder and adjacent thereto; wherein each of the blades provides an edge having an undulating curvature along at least a portion of the edge, the curvature being placed so as to improve the swirling of the air and to dampen noise; whereby air moving radially through the air filters passes through the blades of the open cylinder for rotational entry into the intake manifold.

10. The device of claim 9 wherein the sheet material provides opposing edges, the edges when joined forming the open cylinder.

11. The device of claim 10 wherein the opposing edges are cut at a common angle to a longitudinal axis of the open cylinder.

12. The device of claim 9 wherein each of the blades is generally triangular in shape.

13. The device of claim 9 wherein each of the blades provides a plurality of perforations arranged to form a weakened section in the sheet material so as to more easily form the blade from the sidewall.

14. A method of making a gas swirling device for use in an internal combustion engine, the device adapted to be removably insertable into an engine intake air flow path, the method comprising the steps of: providing a linear strip of a flexible sheet material; cutting a plurality of evenly spaced, Y shaped cuts in a peripheral edge of the strip; bending the strip into an open round cylindrical shape; forming a plurality of individual blades by bending, each of the blades having a smoothly and continuously curved surface directed generally radially inwardly around a circumference of the open cylinder; whereby air moving axially through the device or radially into the device is caused to rotate.

15. The method of claim 14 wherein the cuts are so placed and the bending is so performed as to produce a blade generally projecting inwardly and having a portion projection outwardly from the circumference of the cylindrical shape.

16. The method of claim 14 wherein the forming step results in positioning the blades for causing radial air flow through the device to swirl.

17. The method of claim 14 wherein the forming step results in positioning the blades for causing axial air flow through the device to swirl.

18. An air swirling device comprising: a flexible sheet material providing a first portion formed as an open round cylinder, and a second portion formed along at least one peripheral edge of the open cylinder as a plurality of individual blades evenly spaced around a circumference of the open cylinder, the first and second portions being formed integrally and contiguously from the sheet material, each of the blades providing a smoothly and continuously curved, radially directed surface primarily positioned inboard of the circumference, and shaped so that air moving through the device is caused to move cyclonically with rotational acceleration and mixing; wherein each of the directed surfaces is partially split by a plurality of generally parallel slits to form a plurality of terminal fingers, the terminal fingers of each of the directed surfaces being mutually divergent and positioned for directing portions of the air moving through the device in divergent circumferential directions.

19. The device of claim 18 wherein each of the directed surfaces further comprises at least one hole therethrough, the hole being tapered in the direction of air flow in the at least one hole so as to accelerate the velocity thereof, the at least one hole being directed circumferentially for vectoring the accelerated air circumferentially for improved mixing and for accelerating the cyclonically moving air.

20. The device of claim 18 wherein each of the directed surfaces further comprises a blade portion folded into a funnel shape, the funnel shape being tapered in the direction of air flow in the funnel shape so as to accelerate the velocity of the air flow therewithin, the funnel shapes directed for vectoring the accelerated air circumferentially for improved mixing and for accelerating the cyclonically moving air.

21. The device of claim 18 wherein the opposing edges of the open cylinder are circumferentially mutually overlapped so as to enable increased outwardly directed radial hoop pressure of the cylinder.

22. The air swirling device comprising:

a flexible sheet material providing an open exterior cylinder, and integral therewith, a plurality of open interior cylinders, each of the interior cylinders having a peripheral edge comprising a plurality of individual blades evenly spaced around a circumference thereof, the blades formed integrally and contiguously from the sheet material providing a smoothly and continuously curved radially inwardly directed surface and shaped so that air moving axially through the interior cylinders is caused to rotate.

23. The device of claim 22 wherein the blades of the interior cylinders are curved to cause the air moving therethrough to rotate in the same sense through each of the interior cylinders.

24. The device of claim 23 wherein the blades of the interior cylinders are curved to cause the air moving therethrough to rotate in an alternate sense through at least one of the interior cylinders.

* * * * *